United States Patent [19]

Kitt

[11] 4,020,779

[45] May 3, 1977

[54] CHAIN/WIRE ROPE CONNECTOR ASSEMBLY FOR ANCHOR

[75] Inventor: Daniel G. Kitt, Houston, Tex.

[73] Assignee: Skagit Corporation, Sedro-Woolley, Wash.

[22] Filed: May 19, 1976

[21] Appl. No.: 687,964

[52] U.S. Cl. ..... 114/293; 114/230

[51] Int. Cl.[2] ..... B63B 21/50

[58] Field of Search ..... 114/206 R, 210, 230, 114/144 B; 59/93

[56] References Cited

UNITED STATES PATENTS

| | | | |
|---|---|---|---|
| 3,842,776 | 10/1974 | Wudtke | 114/206 R |
| 3,967,572 | 7/1976 | Lea | 114/206 R |
| 3,985,093 | 10/1976 | Eidem | 114/206 R |

*Primary Examiner*—Trygve M. Blix
*Assistant Examiner*—Jesus D. Sotelo
*Attorney, Agent, or Firm*—Robert C. Smith; William F. Thornton

[57] ABSTRACT

An anchor-deploying structure and method particularly adapted for anchoring an offshore drilling platform employs the use of an anchor, anchor chain and wire rope combination. Separate reeling and storage means are supplied for the wire rope and anchor chain, the wire rope being carried on and deployed from a winch-driven drum and the chain being carried in a chain locker and deployed from and returned to the chain locker by a chain hoist. At the end of the wire rope is a connector which carries a short length of leader chain which may include a swivel. A work station is so located that workmen thereon have access to both the leader chain and a length of lead chain from the chain locker, either of which may be connected to the anchor chain through the use of a special three-way chain link and a pair of removable links. In deploying the anchor, the chain hoist is operated to reel out chain until the special three-way link is at the work platform, at which time a removable link is connected between an unoccupied opening on the three-way link and the leader chain. The chain hoist is then operated to tighten the wire rope line and put slack in the lead chain, thus removing the tension from a second removable link and enabling it to be removed. The wire rope winch is then operated to deploy the anchor to the desired depth. Essentially the reverse of this process is used to recover the anchor and store the wire rope and anchor chain.

5 Claims, 2 Drawing Figures

CHAIN/WIRE ROPE CONNECTOR ASSEMBLY FOR ANCHOR

BACKGROUND OF THE INVENTION

Offshore drilling rigs or platforms may be attached to the ocean bottom or, in substantially deeper water, may be floating types held in a desired position through the use of a plurality of anchors. Since each corner pillar typically may have two anchors and anchor lines, a minimum of eight such anchor lines need to be deployed when the platform is put into position and recovered to permit the platform to be removed. Each such line, particularly if over 500–600 feet in length, usually consists of a length of wire rope attached to a length of chain at the end of which is an anchor. Wire rope has better characteristics than chain with respect to strength per unit of weight but does not, alone, provide a good suspension means for an anchor of the standard type because it tends to be quite stiff, imposing upward forces on the anchor when unloaded and preventing the flukes from digging into the bottom as desired. Thus a length of at least a few hundred feet of chain below the wire rope and next to the anchor tends to provide the best arrangement for proper anchor operation, the chain being attached to a connector between the wire rope and the chain.

In U.S. Pat. No. 3,842,776 filed in the name of Donald J. Wudtke (common assignee), an anchoring system for our offshore platform is described in which a special connector is combined with a special fairlead sheave designed to smoothly guide chain, connector and wire rope in both directions without kinking or otherwise damaging the wire rope. When the anchor lead is being retrieved, the wire rope is wound on a drum by means of a winch until the connector is in a desired position adjacent a work platform or station, at which time a "devil's claw" or similar chain stopping mechanism is attached to one of the chain links and the winch is reversed to put slack in the chain above the devil's claw. A detachable link is then opened to permit the wire rope and connector to be removed and to permit a length of chain from a separate chain locker and windlass to be attached to the anchor chain. The windlass is then operated to draw the chain into the chain locker.

The use of the devil's claw arrangement has certain disadvantages as to cost, maintenance and, primarily, safety. Such devil's claw members are normally attached to the platform with wire rope or chain which is somewhat lighter in weight than the anchor cable/chain combination because their only function is to support the weight of the anchor chain and anchor for a short period. With twelve or more such devices fastened to the outside of the platform and exposed to the elements, including salt water spray, there is a danger that one or more may deteriorate to the point where they may break, permitting the entire anchor chain and anchor to drop to the bottom. At the same time, parts of the devil's claw and/or some chain links may swing or whip in unexpected directions, thus constituting a hazard to personnel at the work station involved with the anchor deployment and retrieval operation.

SUMMARY OF THE INVENTION

Because disconnecting of the anchor chain from a power source (either the winch for the wire rope or the windlass for the chain) appears to be fraught with danger to personnel and equipment, it was recognized that if the desired transfer from winch power to windlass power could be effected without disconnecting the anchor chain from one power source or the other, a considerable improvement in safety could be effected. With removable links connected in the line adjacent the wire rope/chain connector and the chain from the chain locker, a three-way chain link provides a means for enabling the anchor line to be secured to one power source while it is being attached to or disconnected from the other. The anchor is retrieved from the ocean bottom by operating the winch to wind the wire rope onto the drum bringing the connector and adjacent chain links to a work station. The special three-opening link (typical anchor chain links have a welded crosspiece and thereby have two openings) makes it possible to attach a removable link from the windlass before the chain is disconnected from the winch. With the winch line disconnected, the windlass is then operated to carry the anchor chain into a chain locker.

Deployment of the anchor is essentially the reverse of the retrieval process described. The windlass is operated until the anchor chain is reeled out to such length that the special three-opening link is adjacent to or at the work station, at which time the windlass is stopped, a removable chain link near the wire rope/chain connector is opened and attached to the available open space in the three-opening link, another removable chain link is removed from the three-opening link to open the line to the windlass, and the winch is then operated to deploy the length of wire rope required to set the anchor on the ocean bottom.

With the apparatus and method described, a separate devil's claw or similar device becomes unnecessary along with the need to inspect and maintain it. The anchor line is always connected to a source of power—either the winch or the windlass, and the danger to personnel through possible breaking of the devil's claw or its lead is eliminated.

DESCRIPTION OF THE PREFERRED EMBODIMENT

Figure 1:
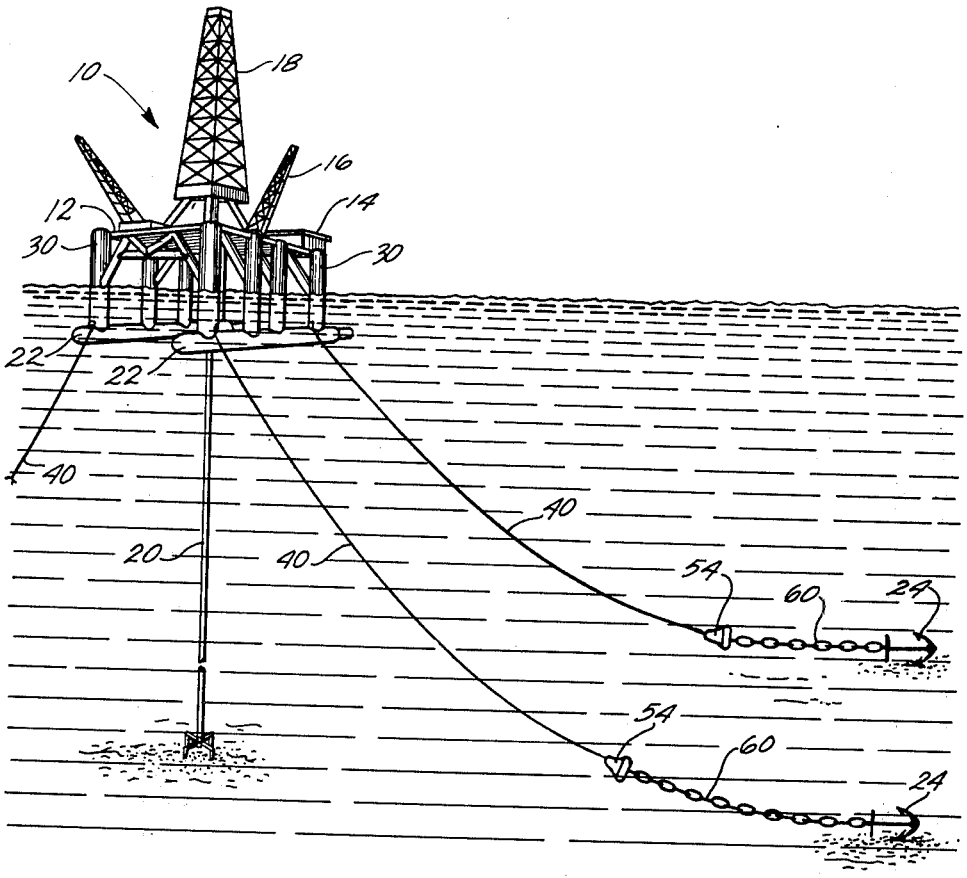
FIG. 1 is a perspective view of a typical offshore drilling platform and anchoring means.

FIG. 1 is a perspective view of an offshore drilling platform 10 of the type for which anchoring systems incorporating my invention are designed. A deck 12 of substantial area, such as approximately 260 feet by 320 feet, supports one or more buildings 14 for housing men and machinery, a number of cranes 16, and a drilling tower 18. Drilling may take place in water up to 2000 feet deep or more with a drill shaft 20 extending vertically downwardly from the tower 18 to a location on the ocean bottom which should be essentially directly below the tower. Flotation for the platform is provided by a pair of large pontoons 22 which are ballasted such that they are submerged to a depth where the wave action is much less than at the surface. The deck is supported on the pontoons by means of a plurality of columns 30. The corner columns may be about 32 feet in diameter. Extending from the corner columns are shown a plurality of anchors 24 attached by means of wire ropes 40, end connectors 54, and a length of anchor chain 60 connected to anchors 24. Although only two such anchor assemblies are shown in detail, it will be appreciated that to maintain the position of platform 10 over the drilling location, at least two or three such anchor assemblies will usually extend from each corner column arranged to resist forces in all directions.

Figure 2:
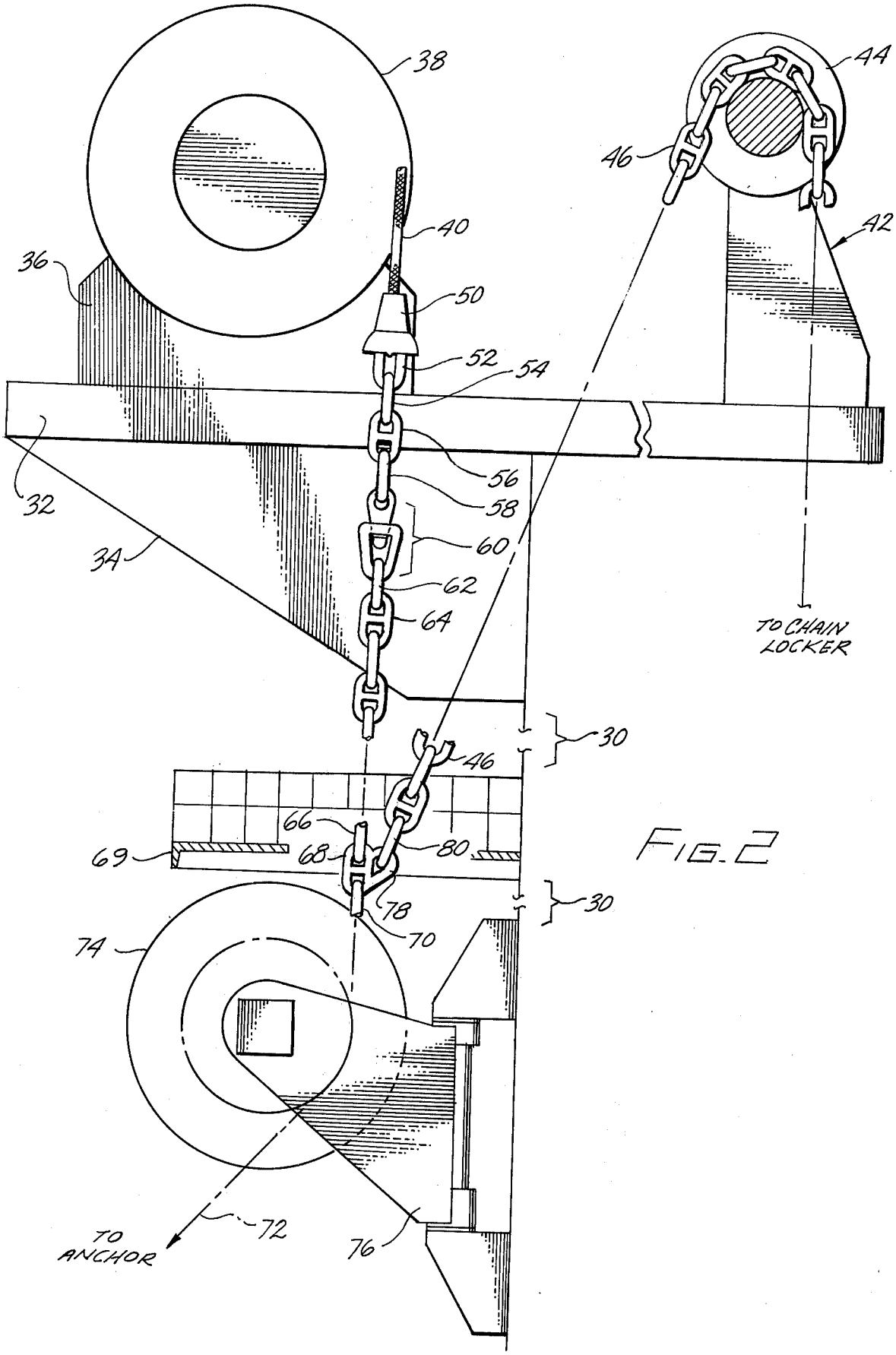
FIG. 2 is a side view of a winch and chain hoist assembly mounted on one column of the above drilling platform, including a wire rope, anchor chain, fairlead, and special chain structure including removable links and a three-way link.

Referring now to FIG. 2, one of the columns for the offshore platform is shown at numeral 30. At the top of this platform is a radially extending annular shelf structure 32 which is supported at various places by means of a plurality of trusses 34 fastened to the side wall of column 30. Mounted on the top surface of annular member 32 is a winch-driven drum assembly 36. A substantial length of wire rope 40 is carried on drum assembly 36.

Also positioned on shelf 32 at some distance from the drum assembly 36 is a chain hoist or windlass 42 including a wildcat 44 driven by suitable motor means and which carries a length of lead chain 46. Chain extending from the right side of the wildcat 44 extends down into a chain locker, not shown.

Wire rope 40 is firmly secured by suitable means to a bell-shaped end connector 50 serving as a means for connecting wire rope 40 with the anchor chain. At its larger end, connector 50 has a cross member for supporting a short length of leader chain including a chain link 52. Attached to link 52 is a detachable link 54 which is, in turn, connected to a conventional link 56 and another detachable link 58 fastened to a swivel assembly 60. Below swivel assembly 60 are a detachable link 62, a common link 64 and a removable link 66 which is, in turn, attached to the special three-way connecting link 68, shown adjacent a work platform 69. An additional removable link 70 connects special three-way link 68 to the remainder of the anchor chain 72. Anchor chain 72 extends downwardly where it is directed around a fairlead sheave 74 fastened to column 30 at some substantial distance below the platform 32. From fairlead 74 the anchor chain 72 extends downwardly and outwardly to an anchor structure, not shown. Fairlead sheave 74 is pivotally attached to column 30 by means of a bracket 76 attached to the side wall of column 30.

The special three-way connecting link 68 consists of a conventional link having a cross member to which is welded an additional loop 78 providing a third opening. This loop is usually a part of a chain link cut off to provide a loop of the desired size. This three-opening link may also be formed by other methods such as forging or casting. To this loop 78 is attached a removable link 80 which is otherwise attached to the end of lead chain 46 extending from the wildcat 44.

In operation, let it be assumed that the anchor structure is essentially all retracted and the anchor itself is properly stowed on its rack on the column 30. At such time essentially all of wire rope 40 will be wound on drum 38, and the lead chain 46 and most of anchor chain 72 will be stowed in the chain locker. When it is desired to deploy the anchor, it is carried out to a desired location by a work boat, the windlass 42 is actuated and wildcat 44 turns, lifting chain out of the chain locker and causing it to be fed outwardly as it is pulled by the work boat. When sufficient chain is fed out and the special three-way link 68 reaches a position adjacent the work platform 69, the work boat and the windlass 42 are stopped. Removable link 66 is then fastened to link 64 and the remaining opening of the special three-way link 68. The windlass is then operated to slacken the lead chain 46 slightly to remove the load from removable link 80. Link 80 is then disconnected from the loop 78 of three-way link 68, and the winch is then operated to reel wire rope 40 outwardly to the desired length. The anchor is then lowered from the work boat to the ocean bottom, and a large buoy is attached to the lowering line to mark the location of the anchor.

Recovery of the anchor, anchor chain and wire rope assembly is essentially the reverse of that described. Although in some cases it is possible for the winch to pull the anchor in directly, the usual arrangement is for the anchor to be raised by a work boat along with most of the chain which had been lying on the bottom. The winch is then operated to wind wire rope onto the drum 38 until the special three-way link 68 is in position adjacent the work platform 69. Removable link 80 is then attached to the last link of lead chain 46 and to the opening defined by loop 78 of special link 68. The winch 38 is then reversed to cause lead chain 46 to pick up the load and remove the load from the removable link 66 after which link 66 is opened to permit it and the wire rope 40 to be separated from three-way link 68. Wildcat 44 is then operated to transfer the lead chain 46 and anchor chain 72 into the chain locker. While three-way link 68 will always align itself properly with respect to fairlead sheave 74 because of swivel 60, care must be taken when link 68 is passed over the wildcat 44 that the hump is in an up position so that it will again pass smoothly over the wildcat 44 upon deployment.

Certain modifications will be apparent to those skilled in the art; e.g., while a specific procedure has been described for putting slack in the line by reeling the chain or wire rope outwardly, it is obvious that in some instances the equivalent effect is produced by reeling the wire rope or chain inwardly, thus putting slack in the opposite line.

I claim:

1. In a system for anchoring a structure in the ocean or similar large body of water, wherein said system includes an anchor, an anchor chain connected to said anchor, a chain locker and a windlass with a length of lead chain for feeding chain into or out of said chain locker, a wire rope, a drum for storing said wire rope, a winch for driving said drum, a connector for connecting said anchor chain to said wire rope including a short length of leader chain, a work station on said structure, a special link having at least three openings connected to said anchor chain; and a first removable link connected to said special link and to said leader chain, a method for retrieving and storing said wire rope, connector and anchor chain comprising the steps of 1. winding said wire rope on said drum until said special link is at said work station,
2. attaching a second removable link of chain to an available opening on said special link and to said lead chain,
3. operating one of said winch and windlass to apply tension to said second removable link and to unload said first removable link,
4. opening and separating said first removable link from another loop and opening of said special link, and 5. operating said windlass to draw a desired length of said anchor chain into said chain locker.

2. A system for anchoring a structure in the ocean or similar large body of water as set forth in claim 1 wherein said anchor chain and wire rope are deployed by 1. operating said windlass to reel out chain from said chain locker until said special link is at said work station,
2. connecting said first removable link to an available loop and opening of said special link,
3. operating one of said winch and windlass to apply tension to said first removable link and to unload said second removable link,
4. opening and separating said second removable link from said special link, and
5. operating said winch to reel a desired length of wire rope from said drum.

3. A method of retrieving and storing wire rope and anchor chain forming part of an anchoring system as set forth in claim 1 wherein a fairlead sheave is located on said structure and swivel means are incorporated between said connector and said special link to aid said special link in passing over said fairlead sheave.

4. An anchoring system for anchoring a structure in deep water, said structure including a work station and at least one fairlead sheave, said system comprising:

an anchor, a substantial length of anchor chain attached to said anchor, a winch and a drum driven thereby and a substantial length of wire rope connected to said drum, a connector member for connecting said wire rope to said anchor chain including a short length of leader chain attached to said connector, a special chain link having at least one extra loop and opening and connected to said anchor chain, a swivel structure forming part of said leader chain, a first removable link connectable to said leader chain and to one of the openings in said special chain link, a windlass, a chain locker, a length of lead chain carried by said windlass, and a second removable link connectable to said lead chain such that upon deployment of said anchor, said first removable link is attached to said special link, said second removable link is separated therefrom, and said winch is operated to permit said anchor chain, connector and wire rope to reel outwardly over said fairlead sheave, said swivel structure permitting said special chain link to align itself as it passes over said fairlead sheave.

5. An anchoring system as set forth in claim 4 wherein a wildcat is driven by said windlass for transferring chain into and out of said chain locker, and the links of said chain are aligned in said locker such that when the chain is carried out of said locker said special link always passes over said wildcat with its extra loop in an up position.

* * * * *